US008573379B2

(12) United States Patent
Brügmann

(10) Patent No.: US 8,573,379 B2
(45) Date of Patent: Nov. 5, 2013

(54) ARTICLE FEED INSERT FOR AN ARTICLE FEED SYSTEM

(75) Inventor: Lars Alexander Brügmann, Schwerte (DE)

(73) Assignee: Dirk A. Brugmann Kunststoff-Verarbeitung GmbH & Co. KG, Hagen (DE)

( * ) Notice: Subject to any disclaimer, the term of this patent is extended or adjusted under 35 U.S.C. 154(b) by 400 days.

(21) Appl. No.: 13/018,808

(22) Filed: Feb. 1, 2011

(65) Prior Publication Data

US 2011/0186401 A1 Aug. 4, 2011

(30) Foreign Application Priority Data

Feb. 2, 2010 (DE) ..... 10 2010 006 746

(51) Int. Cl.
*B65G 13/00* (2006.01)
*B65G 13/11* (2006.01)
*B65G 21/22* (2006.01)

(52) U.S. Cl.
USPC ..... 193/37; 193/35 R; 193/35 C; 198/860.1; 211/144; 211/151

(58) Field of Classification Search
USPC ..... 193/35 C, 35 R, 37; 198/860.1; 211/74, 211/90.01, 126.1, 144, 151, 153; 312/61, 312/71; 414/276, 286
See application file for complete search history.

(56) References Cited

U.S. PATENT DOCUMENTS

| | | | | |
|---|---|---|---|---|
| 8,276,772 | B2 * | 10/2012 | Kim | 211/151 |
| 2006/0108306 | A1 | 5/2006 | Minchey | 211/175 |
| 2010/0072152 | A1 * | 3/2010 | Kim | 211/151 |
| 2010/0078402 | A1 * | 4/2010 | Davis et al. | 211/184 |
| 2010/0133214 | A1 * | 6/2010 | Evans | 211/85.8 |
| 2010/0133219 | A1 * | 6/2010 | Sun | 211/151 |
| 2010/0206829 | A1 * | 8/2010 | Clements et al. | 211/162 |
| 2013/0015155 | A1 * | 1/2013 | Brugmann | 211/151 |

FOREIGN PATENT DOCUMENTS

| | | | |
|---|---|---|---|
| JP | 07-061529 | 3/1995 | B65G 1/08 |
| WO | WO 2009/075409 | 6/2009 | A47F 3/14 |
| WO | WO 2009/097655 | 8/2009 | A47B 96/00 |

* cited by examiner

*Primary Examiner* — Leslie A Nicholson, III
(74) *Attorney, Agent, or Firm* — Kusner & Jaffe

(57) ABSTRACT

An article feed insert for an article feed system for automatic conveyance of articles located along the article feed insert in one conveyance direction B to a visual edge of a shelf equipped with the article feed system with the following features: a set of conveying rollers which are supported on the roller carrier transversely to the conveyance direction B, two profile rails which can be attached independently of one another to the opposite sides of the roller carrier for fixing of the conveying rollers on the roller carrier, a first fixing element which can be attached to one visible edges of the roller carrier for fixing the profile rails, and a second fixing element which can be attached opposite the first fixing element to the roller carrier for fixing the profile rails.

12 Claims, 2 Drawing Sheets

ARTICLE FEED INSERT FOR AN ARTICLE FEED SYSTEM

FIELD OF THE INVENTION

The invention relates to an article feed insert for an article feed system for automatic conveyance of articles located along the article feed insert in one conveyance direction to a visual edge of a shelf equipped with the article feed system.

BACKGROUND OF THE INVENTION

Both in retail and also wholesale businesses such as for example drugstores, grocery stores, discount stores, toy stores and the like, shelves are necessary for storage and display of products. When the product is set up and is also stored, it is desirable that the respective product be as flush as possible with adjacent products on the shelf bottoms on the front so that the product is easily visible and accessible to the consumer and the arrangement of products is aesthetically pleasing. To implement this arrangement of products, known systems comprise the use of a push system to push the respective product or the row of products in the direction of the front of the shelf when the frontmost product is being removed or products are being restocked.

There can be separation plates for separation of adjacent rows of products.

This article feed system is shown for example in WO 2009/097655 A1 which a plurality of article feed inserts, consisting of a roller-holding inner housing and an outer housing which holds the inner housing and two end caps which can be slipped onto the outer housing to the front and back and which are placed on a carrier in a tilted arrangement, as shown in FIG. 7 of WO 2009/097655 A1. The article is fed by virtue of the inclined position, therefore without mechanical or electrical force application/energy use, specifically solely by the force of gravity.

SUMMARY OF THE INVENTION

The object of this invention is to provide an article feed insert which can be used more flexibly and which can be produced more economically.

This object is achieved with the features set forth in the independent claim(s). Advantageous developments of the invention are given in the dependent claims and all combinations of at least two of the features given in the specification, claims and/or figures are included within the framework of the invention.

The basic idea of this invention is to provide two profile rails which can be attached independently of one another to the opposite sides of the roller carrier instead of an outer housing for fixing of the conveying rollers on the roller carrier.

In this way, on the one hand a different width of the article feed insert can be implemented with the same profile rail, as can also a different length of the article feed insert by cutting to length, so that the article feed insert of the present invention can be used more flexibly. Moreover less material is needed for fixing of the conveying rollers on the roller carrier which can be made of plastic in the same manner as the conveying rollers and the fixing elements, for reasons of cost. The profile rails for fixing the conveying rollers have a lower weight than the outer housing according to the prior art so that there can also be less material and thus a lower weight with the same stability. Moreover the material costs are also reduced in this way.

Mounting of the article feed insert is greatly simplified by the first and/or second fixing element being able to be fixed on the profile rails without screws and cement, according to one embodiment of the invention.

According to another embodiment of the invention, it is provided that the first and/or second fixing element can be fixed by positive contact, especially without additional components, on the profile rails, especially in the transverse direction and in the longitudinal direction to the conveyance direction B. This enables a connection as simple but effective as possible between the profile rails and the fixing element so that the roller carrier and the conveying rollers are reliably held in their operating position.

In another advantageous embodiment of the invention, it is provided that the first and/or second fixing element can be fixed on the profile rails by at least partial deformation of the profile rails. This measure further simplifies the article feed insert of the present invention in the number of parts and in this way also the mounting of the article feed insert so that production costs are reduced.

To the extent the second fixing element is made integral with the roller bearing, the number of parts necessary for mounting of the article feed insert of the present invention is still further reduced and the stability of the overall structure is improved.

In another advantageous embodiment of the invention it is provided that the profile rails are made as a U-profile to hold the roller carrier in the U-profile by clamping. In particular, clamped holding in combination with the deformation of the profile rails effects especially simple mounting since additional aids are unnecessary and the profile rails independently of one another provide for fixing of the conveying rollers in the roller carrier. It is especially advantageous for the clamping action if at least one leg of the U-profile is slightly tilted to the inside, especially at an angle from 85 to 89 degrees, preferably exactly 88 degrees.

It is advantageously further provided that to secure the roller carrier in the conveyance direction there are catch projections in the U-profile of the profile rails. These catch projections can be advantageous for example for premounting of the roller carrier with the rollers on the profile rails.

According to another advantageous embodiment of the invention, it is provided that the profile rails on their side facing away from the roller carrier have corresponding profiling. In this way, the article feed inserts of the present invention are even plug-compatible with themselves, for example by tongue and groove connection.

Dividers for dividing adjacent product groups can be arranged in flexible separation by the first and second fixing element each having at least one divider holder, preferably a plurality of adjacent ones.

According to another advantageous embodiment of the invention it is provided that the profile rails are made flush in the first and/or second fixing element. In this way the profile rails have a flat, lateral outer contour and can be easily stacked, transported and installed.

The invention moreover relates to an article feed system with at least one article feed insert which is tilted in the article feed system to one visible edge of an article feed insert of the present invention. These advantages and embodiments also apply analogously to the article feed system of the present invention.

Other advantages, features and details of the invention will become apparent from the following description of preferred exemplary embodiments and using the drawings.

BRIEF DESCRIPTION OF THE DRAWINGS

The same parts or those with identical action are labeled with the same reference numbers in the drawings.

DETAILED DESCRIPTION OF THE INVENTION

Figure 1:
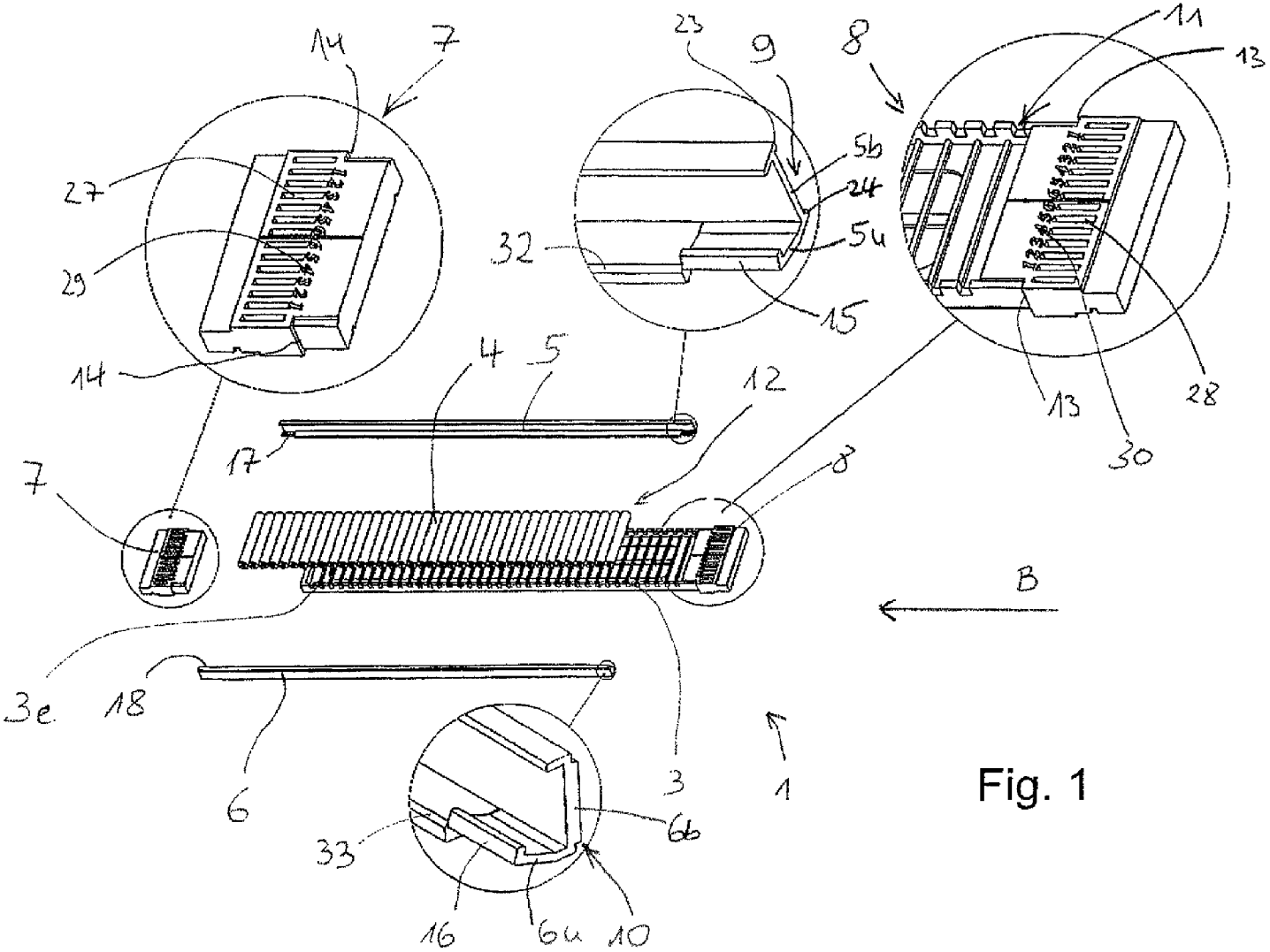
FIG. 1 shows a perspective exploded diagram of an article feed insert of the present invention with extract enlargements and FIG. 2 shows a perspective view of an article feed insert of the present invention from overhead and underneath with one extract enlargement.
Figure 2:
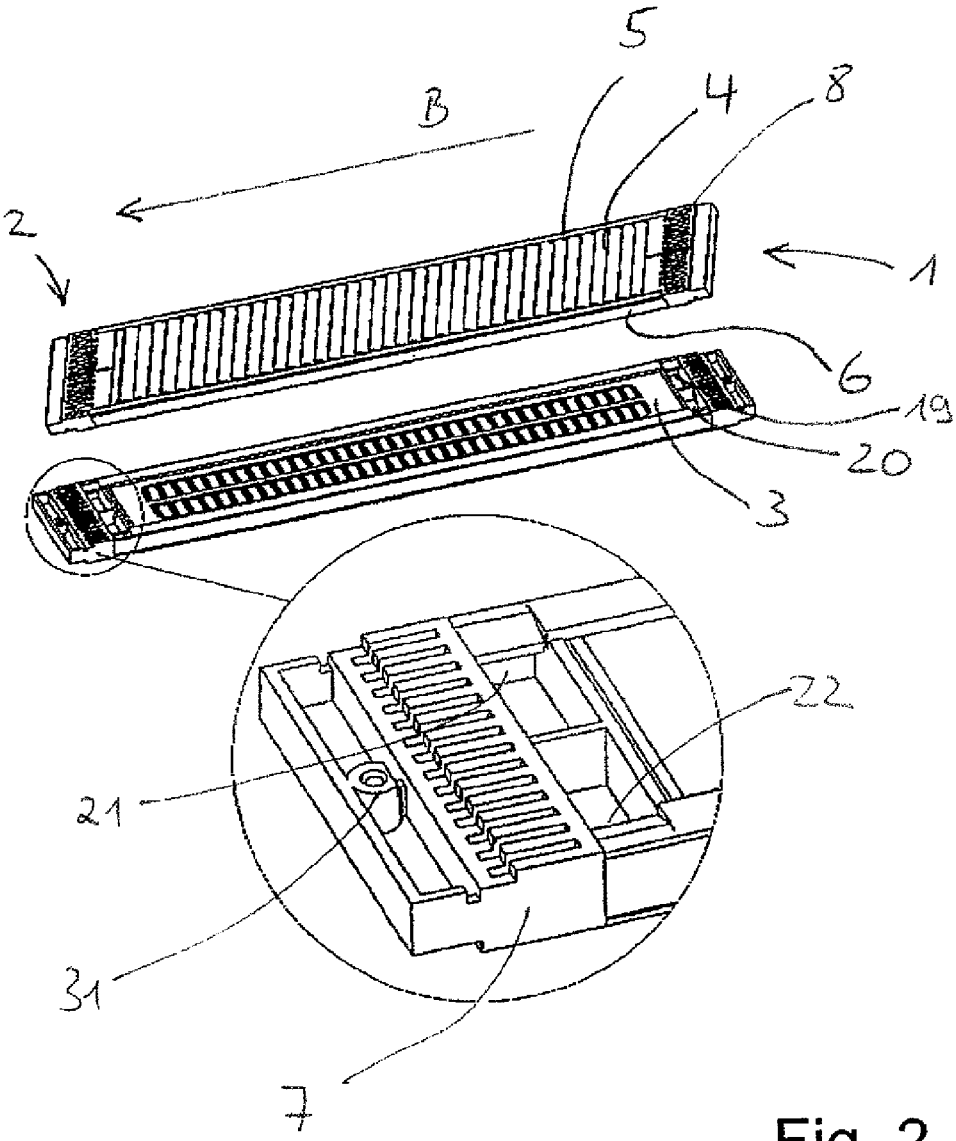

FIG. 1 shows an article feed insert 1 which has been disassembled, how it is used for example in a holding device described according to FIG. 7 from WO 2009/097655.

Depending on the size of the articles to be conveyed by one or more article feed inserts 1 to one visible edge 2 in one conveyance direction B, various or several of the article feed inserts 1 can be used. They can moreover be supported by dividers so that neater guidance of the products located on the shelves, for example separated according to groups of articles, is easily enabled.

The article feed insert 1 comprises a roller carrier 3 for holding a set of conveying rollers 4 which are supported in the roller carrier 3 in the corresponding conveying roller holders 11.

The conveying rollers 4 are arranged transversely to the conveyance direction B and both the roller carrier 3 and also the conveying rollers 4 are advantageously formed from plastic in order to enable, on the one hand, low-friction and on the other, quiet conveyance. Moreover production of the roller carrier 3 and of the conveying rollers 4 from plastic is also economically possible.

The conveying rollers 4 form a conveyance path 12 and due to the sloped arrangement of the article feed insert 1 on the carrier, products which have been placed on the conveyor belt 12 are automatically conveyed to one end 3*e* of the visible edge of the roller carrier 3. No expenditure of force is necessary for this purpose.

So that the conveying rollers 4 are secured in the conveying roller holders 11, profile rails 5, 6 with a U-profile can be clamped laterally onto the roller carrier 3 so that the conveying rollers 4 in the conveying roller holder 11 are each fixed such that the conveying rollers 4 can rotate freely, but cannot spring out of their conveying roller holder 11. The profile rails 5, 6 are formed advantageously from aluminum, especially as an extruded profile.

For purposes of mounting, the profile rails 5, 6 are slipped from the end 3*e* of the visible edge onto the roller carrier 3 until the profile rails 5, 6 adjoin the stops 13 of a second fixing element 8. The length of the profile rails 5, 6 is matched to the length of the roller carrier 3 such that on the end 3*e* of the visible edge a first fixing element 7 can be accommodated as far as the corresponding stops 14 into the profile rails 5, 6.

In one alternative embodiment the first and second fixing elements 7, 8 are made integral with the roller carrier 3. The fixing elements 7, 8 can be clipped onto the roller carrier 3 in this case, especially by two catch projections which are located on the inner edge of the U-profile of the profile rails 5, 6 and which are formed analogously to the catch projections 32, 33 of the profile rails 5, 6. They can be locked into the corresponding recesses along the sides of the roller carrier 3 by first one of the catch projections being hooked in and then the catch projection which is the opposite one at the time being locked in place at the same time by lateral application of force, preferably on the two profile rails 5, 6.

To fix the first and second fixing elements 7, 8, fixing sections 15, 16, 17, and 18 of the profile rails 5, 6 are deformed in their U-profile to the inside such that they engage corresponding fixing sections 19, 20, 21 and 22 of the first and second fixing elements 7, 8. In this way the roller carrier 3, the first and second fixing elements 7, 8 and the two profile rails 5, 6 are fixed both in the conveyance direction and also transversely to the conveyance direction.

Advantageously there are fixing sections 15, 16, 17 and 18 on the ends of the profile rails 5, 6, specifically by one end section of one lower leg 5*u*, 6*u* at a time being cut off as far as one bottom 5*b*, 6*b* of the respective U-profile of the profile rails 5, 6.

The bottom 5*b* of the profile rail 5 at the same time forms profiling 9 on the side opposite the U-profile for holding the roller carrier 3, the profiling 9 furthermore having two side cheeks 23, 24.

The bottom 6*b* of the profile rail 6 forms profiling 10 which corresponding to profiling 9 by the bottom 6*b* coming into contact with the bottom 5*b*' of a corresponding article feed insert 1'. The profiling 10 in this respect has recesses 25, 26 which correspond to the side cheeks 23, 24. The profiling 9 and the profiling 10 are made as a tongue and groove connection in this embodiment.

For holding of the roller carrier 3 by the profile rails 5, 6 by clamping the lower legs 5*u*, 6*u* and/or the upper legs 5*o*, 6*o* which are opposite the lower legs 5*u*, 6*u* are angled relative to the bottoms 5*b*, 6*b*, especially at an angle between 85 and 89 degrees, preferably an angle of 88 degrees.

The first and second fixing elements 7, 8 have a plurality of divider holders 27, 28 which are arranged flush with one another and transversely to the conveyance direction B along the first and second fixing elements 7, 8. Corresponding divider holders 27, 28 are provided with corresponding identifications 29, 30 for easier assignment of the divider holders 27, 28 which correspond at the time.

To fix the article feed insert 1 on the carrier which is not shown here, there is one internal thread 31 at a time on each first and second fixing element 7, 8, especially molded on.

The roller carrier 3 and the second fixing element 8 are preferably made of plastic in one piece.

REFERENCE NUMBER LIST

B conveyance direction
1 article feed insert
2 visual edge
3 roller carrier
3*e* end of visual edge
4 conveying rollers
5 profile rail
5*b* bottom
5*o* upper leg
5*u* lower leg
6 profile rail
6*b* bottom
6*o* upper leg
6*u* lower leg
7 first fixing element
8 second fixing element
9 profiling
10 profiling
11 conveying roller holder
12 roller way
13 stops
14 stops
15, 16, 17, 18 fixing sections
31 internal thread
32, 33 catch projections

19, 20, 21, 22 fixing sections
23, 24 side cheeks
25, 26 recesses
27, 28 divider holders
29, 30 identifications Having described the invention, the following is claimed:

1. Article feed insert for an article feed system for automatic conveyance of articles located along the article feed insert in one conveyance direction B to a visual edge of a shelf equipped with the article feed system, the article feed insert comprising:

a roller carrier for holding a set of conveying rollers, wherein the set of conveying rollers are supported on the roller carrier transversely to the conveyance direction B, two profile rails attached independently of one another to opposite sides of the roller carrier for fixing the set of conveying rollers on the roller carrier, a first fixing element attached to a first end of the roller carrier, wherein said first fixing element is fixed to the two profile rails, and a second fixing element integrally attached to a second end of the roller carrier opposite the first end.

2. Article feed insert as claimed in claim 1, wherein the first fixing element is fixed to the profile rails without screws and cement.

3. Article feed insert as claimed in claim 1, wherein the first fixing element is fixed by positive contact to the profile rails without additional components, in the transverse direction and in the longitudinal direction to the conveyance direction B.

4. Article feed insert as claimed in claim 1, wherein the first fixing element is fixed to the profile rails by at least partial deformation of the profile rails.

5. Article feed insert as claimed in claim 1, wherein the profile rails are made as a U-profile to hold the roller carrier in the U-profile by clamping.

6. Article feed insert as claimed in claim 1, wherein said profile rails have catch projections in a U-profile of the profile rails to secure the roller carrier in the conveyance direction B.

7. Article feed insert as claimed in claim 1, wherein the profile rails on their side facing away from the roller carrier have corresponding profiling for parallel arrangement and fixing of several article feed inserts.

8. Article feed insert as claimed in claim 1, wherein the first and second fixing element each have at least one divider holder.

9. Article feed insert as claimed in claim 1, wherein the profile rails are made flush with the first fixing element.

10. Article feed insert as claimed in claim 1, wherein said roller carrier further comprises a conveying roller holder for supporting said set of conveying rollers.

11. Article feed system with at least one article feed insert which is tilted to a visible edge of an article feed insert comprising:

a roller carrier for holding a set of conveying rollers, wherein the set of conveying rollers are supported on the roller carrier transversely to the conveyance direction B, two profile rails attached independently of one another to opposite sides of the roller carrier for fixing of the conveying rollers on the roller carrier, a first fixing element attached to a first end of the roller carrier, wherein said first fixing element is fixed to the two profile rails, and a second fixing element integrally attached to a second end of the roller carrier opposite the first end.

12. Article feed insert as claimed in claim 11, wherein said roller carrier further comprises a conveying roller holder for supporting said set of conveying rollers.

* * * * *